United States Patent [19]

Sauer et al.

[11] 4,205,815

[45] Jun. 3, 1980

[54] SHELF BRACKET, SHELF BRACKET-STUD COMBINATION AND SHELF BRACKET-CLIP COMBINATION

[75] Inventors: Gale E. Sauer, Williamsville; John A. Gasper, Eden, both of N.Y.

[73] Assignee: Roblin Industries, Inc., Buffalo, N.Y.

[21] Appl. No.: 961,417

[22] Filed: Nov. 16, 1978

[51] Int. Cl.[2] ..... A47G 29/02

[52] U.S. Cl. ..... 248/243; 52/36; 211/192; 248/222.1; 248/222.2

[58] Field of Search ..... 108/108, 152; 248/243, 248/242, 222.2, 222.1, 73; 312/306, 281; 211/190, 192, 182, 208, 175, 153, 197, 149; 52/36

[56] References Cited

U.S. PATENT DOCUMENTS

| | | | |
|---|---|---|---|
| 813,501 | 2/1906 | Keil | 248/243 |
| 2,136,109 | 11/1938 | Kress | 248/243 X |
| 2,453,254 | 11/1948 | Odin | 248/242 |
| 3,550,891 | 12/1970 | Scott | 248/242 |
| 3,572,626 | 3/1971 | Bertschi | 248/243 |
| 3,627,247 | 12/1971 | Krikorian | 108/108 X |
| 3,905,572 | 9/1975 | Hikai | 248/242 |
| 4,048,768 | 9/1977 | Good | 52/36 |
| 4,133,433 | 1/1979 | Wolf | 211/192 |

FOREIGN PATENT DOCUMENTS

| | | | |
|---|---|---|---|
| 6503140 | 12/1966 | Netherlands | 248/242 |

*Primary Examiner*—James T. McCall

*Attorney, Agent, or Firm*—Christel, Bean & Linihan

[57] ABSTRACT

A shelf bracket adapted to be secured to an upright by means of a bracket clip. The shelf bracket comprises attachment means for attaching the bracket to the upright. The attachment means comprises a slot adapted to receive the bracket clip thus removably securing the bracket to the upright.

A shelf bracket-stud combination is disclosed which comprises a stud, a bracket clip, and a shelf bracket. The shelf bracket comprises attachment means for attaching the bracket to the stud. The attachment means comprises a slot adapted to receive the bracket clip such that the location of the bracket on the stud may be varied by varying the position of the bracket clip within the slot.

Also disclosed is a shelf bracket-clip combination which comprises a bracket clip and a shelf bracket. The shelf bracket comprises attachment means for attaching the bracket to a stud. The attachment means comprises a slot adapted to receive the bracket clip such that the location of the bracket clip on the upright may be varied by varying the position of the bracket clip within the slot.

13 Claims, 7 Drawing Figures

FIG. 1
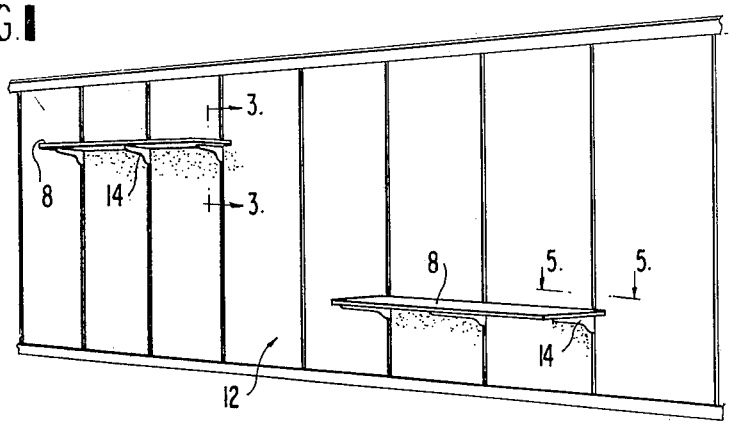
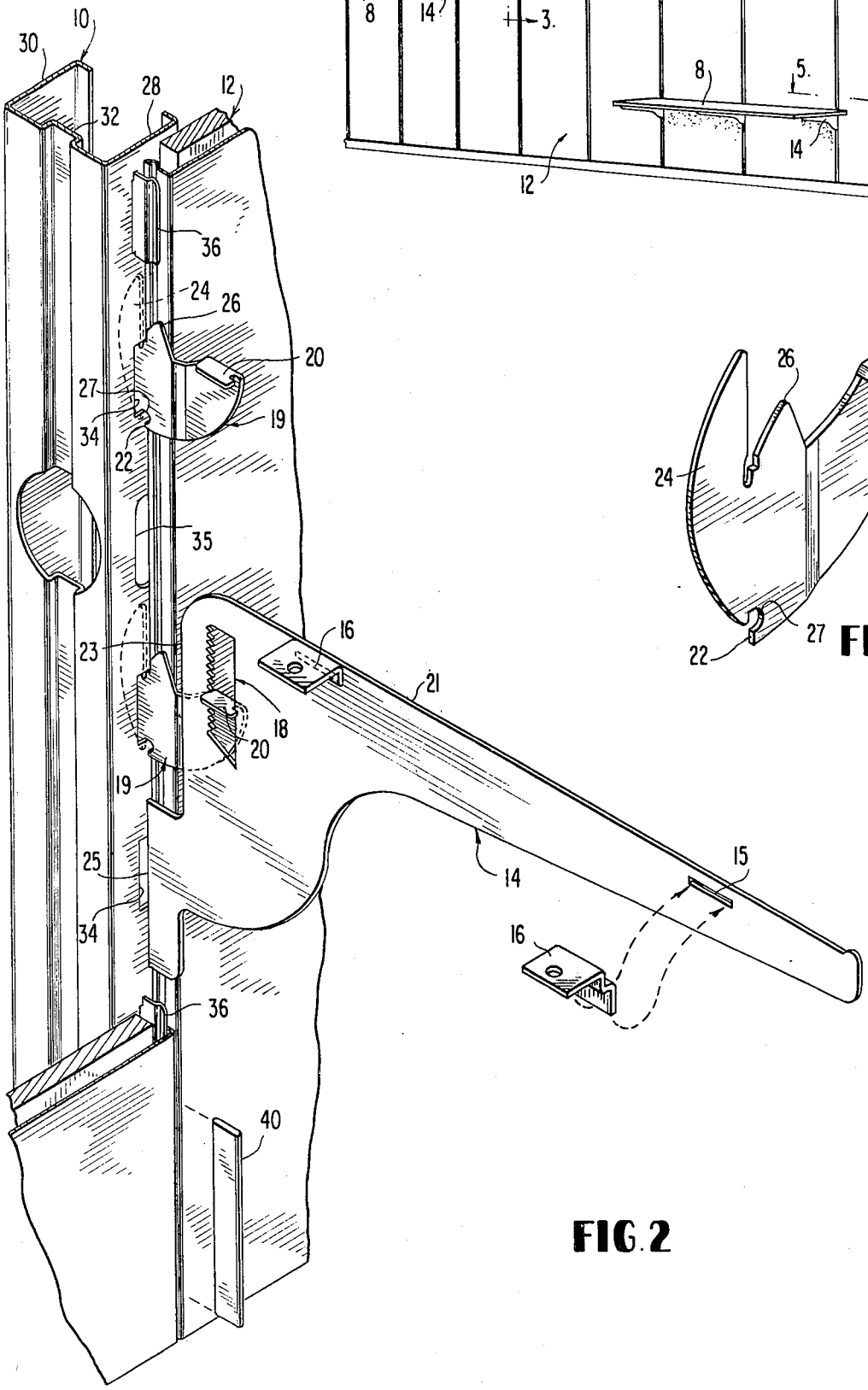
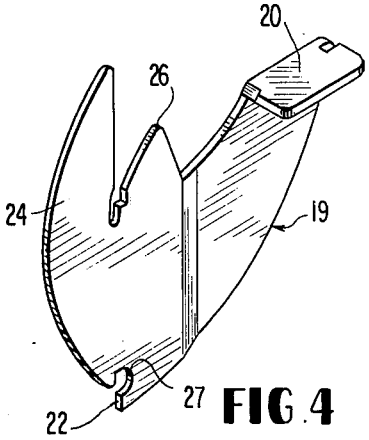
FIG. 4
FIG. 2

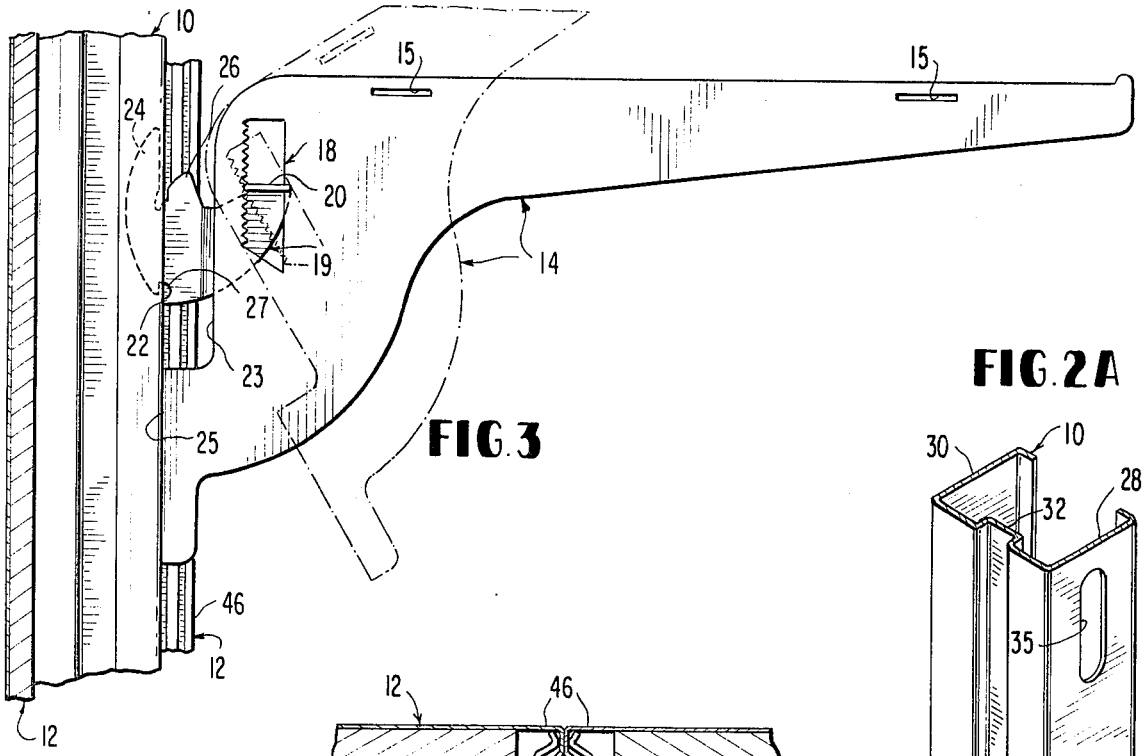
FIG. 3
FIG. 2A
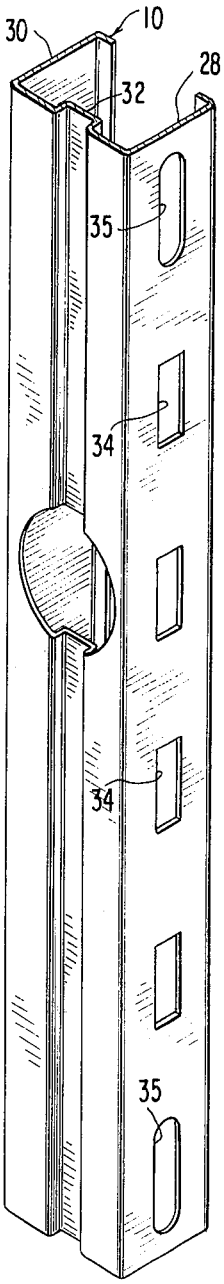
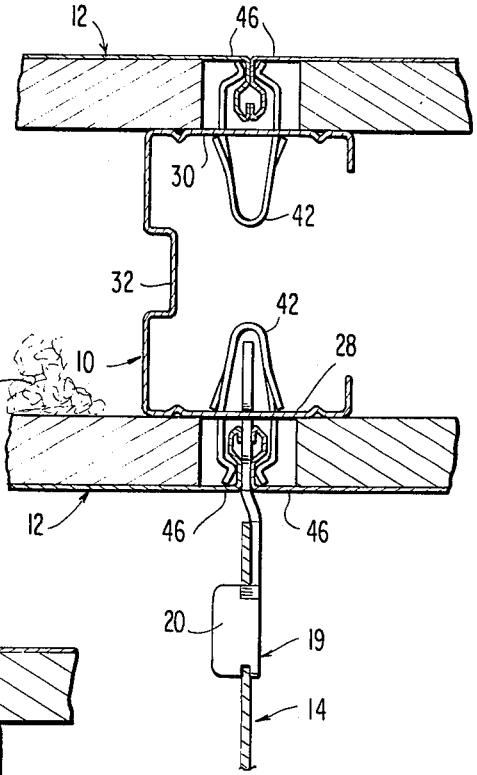
FIG. 5
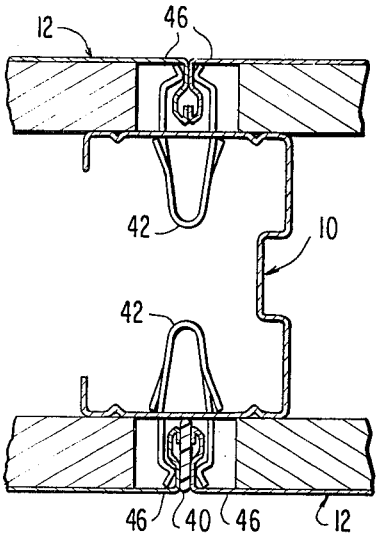
FIG. 6

SHELF BRACKET, SHELF BRACKET-STUD COMBINATION AND SHELF BRACKET-CLIP COMBINATION

BACKGROUND OF THE INVENTION

1. Field of the Invention

The invention relates to a shelf bracket which may be inserted within an upright so as to be able to provide support for shelves and the like.

2. Description of the Prior Art

Numerous shelf bracket arrangements are commercially available for use with wall units and other kinds of general purpose shelving.

U.S. Pat. No. 3,353,684 to Chesley discloses an adjustable shelf structure which comprises shelf support brackets. The brackets themselves comprise hook members which are adapted to be inserted within uprights so as to be secured thereon. Along the lower edge of the brackets an adjustor or locking section is provided whose position may be varied so as to lock the brackets in slightly different positions.

U.S. Pat. No. 3,511,193 to Schild discloses a shelf and bracket structure wherein the bracket has intricately shaped fingers or projections for locking into slots in an upright.

U.S. Pat. No. 3,562,970 to Schwartz discloses an adjustable shelf carrier arrangement which comprises a slotted upright so that shelf supports may be inserted into the upright at various positions thereof.

SUMMARY OF THE INVENTION

It is an object of the invention to provide a shelf support system in which shelf brackets may be simply and securely fitted onto uprights such as studs or the like.

It is a further object of the invention to provide a shelf bracket support whose position may be vertically varied by inserting the bracket within different slots vertically arranged within an upright.

Yet another object of the invention is to provide a bracket support system in which the shelf bracket vertical position may be varied incrementally when associated with a single slot along the height of a stud or like upright support.

These and other objects of the invention are fulfilled by providing a shelf bracket which is adapted to be secured to an upright by means of a bracket clip. The shelf bracket comprises attachment means for attaching the bracket to the upright. The attachment means comprises a slot adapted to receive the bracket clip thus removably securing the bracket to the stud.

In one embodiment of the invention, the shelf bracket may be used in combination with a stud such that the combination comprises a stud, a bracket clip and a shelf bracket. The shelf bracket comprises attachment means for attaching the bracket to the stud. The attachment means comprises a slot adapted to receive the bracket clip such that the location of the shelf bracket on the stud may be varied by varying the position of the bracket clip within the slot.

The objects of the invention are further fulfilled by means of a shelf-clip combination which comprises a bracket clip and a shelf bracket. The shelf bracket comprises attachment means for attaching the bracket to an upright. The attachment means comprises a slot adapted to receive the bracket clip such that the location of the bracket on the upright may be varied by varying the position of the bracket clip within the slot.

BRIEF DESCRIPTION OF THE DRAWINGS

FIG. 1 illustrates shelf brackets according to the invention mounted on a wall to support shelves;

FIG. 2 is a perspective view of the shelf bracket supported on a stud by means of a clip flange;

FIG. 2*a* is a perspective view of a stud with cut-outs;

FIG. 3 is a side view of the bracket supported on a stud as seen along 3—3 of FIG. 1;

FIG. 4 is a magnified perspective view of the bracket clip of the invention;

FIG. 5 is a top cross-sectional view along 5—5 of FIG. 1; and

FIG. 6 illustrates an alternative embodiment to that of FIG. 5.

DESCRIPTION OF PREFERRED EMBODIMENTS

FIG. 1 illustrates a panelled wall section provided with shelves 8 supported on brackets 14 along various heights of the wall.

As seen in FIG. 2, an upright such as a stud 10 is used to support a wall panel 12. FIG. 2*a* is an isolated view of the upright support stud. As shown, the stud 10 comprises first wall 28 and second wall 30 separated by a recessed wall 32. The wall 12 is clamped onto the stud by means of a stud retainer 36. The retainer 36 is fitted within the bracket knock-out 34.

Bracket 14 which may be used to support shelves and the like is secured to the upright by means of a clip-flange 20 within a bracket knock-out 34 or stud knock-out 35. The bracket 14 is provided with a horizontal slit 15 adapted to receive a security clip 16 to which the shelf or the like may be secured.

The bracket is secured to the stud by means of clip flange 20 fitted into slot 18 which in turn is vertically arranged within the bracket adjacent the intersection of the horizontal edge 21 and first vertical edge 23 of the bracket. Quite obviously the location of quadrilateral slot 18 may be varied while still falling within the scope of the invention.

The slot 18 is vertically arranged and is provided with serrations 17. Clip flange 20 is fitted within slot 18 and hooks into the upstanding stud, thus locking the bracket against the stud.

As seen in FIG. 4, a "U" shaped bracket clip 19 comprises a clip flange 20, an upper shoulder 26, a lower shoulder 22, a recess 27 and a hook 24. The clip flange 20 is provided with a slit such that it fits within the slot of the bracket and secures the bracket at a particular height. As will be seen, the height of the bracket may be adjusted by varying the location of the clip flange 20 within the slot 18.

FIG. 3 is a side view of the bracket and illustrates in dashed lines how the bracket is secured to the upright stud by means of the bracket clip 19. The bracket clip 19 is first inserted in the upright and is stabilized by means of recess 27. Next, clip flange 20 is fitted into slot 18 of the bracket while the horizontal edge of the bracket forms an acute angle with the upright stud. The bracket is then lowered so that the second vertical edge 25 contacts the stud and stabilizes the bracket against further movement.

FIG. 5 is a top view of the bracket when inserted in a particular wall structure. As shown, two dimension wall panels 12 are arranged on either side of the stud 10.

The panels may be held against the stud by means of a system described in U.S. Pat. No. 3,925,948, the disclosure of which is hereby incorporated by reference. A utility clip, inserted on the first and second walls of the stud, receives snap-lock clips 46 associated with the edges of the dimension wall panels so as to securely hold them against the stud. The utility clip 42 is sufficiently resilient so as to be able to accomadate insertion of the bracket clip 19 where desired and provides additional lateral stability of the bracket clip with respect to the stud. Insulation 44 may be provided between each of the walls made up of the dimension wall panels 12.

FIG. 6 is a top cross-sectional view of the assembly along a section of the stud where a bracket clip 19 has not been inserted. As may be seen from this figure, an insert 40 may be inserted between the snap-lock clips 46 (see also FIG. 2).

Although the invention has been described with respect to particular embodiments such as, for example, the use of dimension wall panels provided with snap-lock clips, it is to be understood that the invention is applicable to all types of wall assemblies and that the use of specially constructed dimension wall panels does not form an essential part of the invention. Furthermore, it is to be understood that the invention is not limited to the use of any particular construction materials and that substitutions for any of the elements described may be made without departing from the scope of the invention, the invention being limited only by the scope of the claims.

What is claimed is:

1. A shelf bracket adapted to be secured to an upright by means of a bracket clip, said shelf bracket comprising:

attachment means for attaching said bracket to said upright, said attachment means comprising a quadrilateral slot having serrations arranged along the inner surface of one side thereof and adapted to receive said bracket clip thus removably securing said shelf bracket to said upright.

2. The shelf bracket as defined by claim 1 wherein said bracket has a horizontal edge adapted to support a shelf and a vertical edge approximately perpendicular to said horizontal edge, said slot being located adjacent the inersection of said vertical and horizontal edges, and said slot being further arranged to extend along an axis substantially parallel with respect to said vertical edge.

3. The shelf bracket as defined by claim 2 wherein said vertical edge is a first vertical edge and said bracket additionally comprises a second vertical edge displaced horizontally from said first vertical edge and arranged so as to contact said upright to stabilize said bracket with respect to said upright.

4. A shelf bracket-stud combination comprising:

(a) a stud;

(b) a bracket clip; and (c) a shelf bracket having a horizontal edge adapted to support a shelf, a first vertical edge substantially perpendicular to said horizontal edge, a second vertical edge horizontally displaced from said first vertical edge and arranged so as to contact said stud to stabilize said bracket with respect to the stud, and a slot located adjacent the intersection of said horizontal and first vertical edges, said slot being further arranged to extend along an axis substantially parallel to said vertical edges and adapted to receive said bracket clip such that the location of said shelf bracket on said stud may be varied by varying the position of said bracket clip within said slot.

5. The shelf bracket-stud combination as defined by claim 4 wherein said bracket clip is "U" shaped and comprises a clip flange at one end of said clip adapted to be received within said slot.

6. The shelf bracket-stud combination as defined by claim 5 wherein said slot comprises a surface provided with serrations and said clip flange extends from one end of said slot to said serrations.

7. The shelf bracket-stud combination as defined by claim 6 wherein said stud comprises at least one bracket knockout and said bracket clip ends in a hook adapted to be received within said knockout.

8. The shelf bracket-stud combination as defined by claim 7 wherein said bracket clip comprises an upper and lower shoulder arranged at the intermediate portion of said bracket clip, said upper and lower shoulders limiting the extent to which said clip may be inserted into said knockout.

9. A shelf bracket-clip combination comprising:

(a) a "U" shaped bracket clip having a clip flange at one end thereof; and (b) a shelf bracket comprising attachment means for attaching said bracket to an upright, said attachment means comprising a slot having a surface provided with serrations and adapted to receive the clip flange of said bracket clip such that the location of said bracket on said upright may be varied by varying the position of said clip flange within said slot.

10. The shelf bracket-clip combination as defined by claim 9 wherein said bracket is provided with at least one horizontal slit.

11. The shelf bracket-clip combination as defined by claim 10 further comprising a security clip arranged within each of said horizontal slits.

12. The shelf bracket-clip combination as defined by claim 9 wherein said bracket clip ends in a hook adapted to be received within said upright.

13. The shelf bracket-clip combination as defined by claim 12 wherein said bracket clip comprises an upper and lower shoulder arranged at the intermediate portion of said bracket clip, said upper and lower shoulders limiting the extend to which said clip may be inserted into said upright.

* * * * *